US011944118B2

(12) United States Patent
Cheong et al.

(10) Patent No.: US 11,944,118 B2
(45) Date of Patent: Apr. 2, 2024

(54) AEROSOL-GENERATING ARTICLE AND AEROSOL-GENERATING SYSTEMS

(71) Applicant: KT&G CORPORATION, Daejeon (KR)

(72) Inventors: Bong Su Cheong, Daejeon (KR); Dong Kyun Ko, Sejong (KR); Jae Sung Noh, Cheonan-si (KR); Sang Won Choi, Daejeon (KR); Jung Seop Hwang, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 588 days.

(21) Appl. No.: 17/265,705

(22) PCT Filed: Nov. 13, 2019

(86) PCT No.: PCT/KR2019/015427
§ 371 (c)(1),
(2) Date: Feb. 3, 2021

(87) PCT Pub. No.: WO2020/105945
PCT Pub. Date: May 28, 2020

(65) Prior Publication Data

US 2021/0307380 A1 Oct. 7, 2021

(30) Foreign Application Priority Data

Nov. 23, 2018 (KR) ..... 10-2018-0146531

(51) Int. Cl.
*A24D 1/02* (2006.01)
*A24D 1/20* (2020.01)
*A24D 3/17* (2020.01)

(52) U.S. Cl.
CPC ..... *A24D 1/025* (2013.01); *A24D 1/20* (2020.01); *A24D 3/17* (2020.01)

(58) Field of Classification Search
CPC . A24D 1/02; A24D 1/025; A24D 1/20; A24D 3/17; A24D 3/18
(Continued)

(56) References Cited

U.S. PATENT DOCUMENTS 10,524,503 B2 1/2020 Florack et al.
2010/0006112 A1 1/2010 Yang et al.
(Continued)

FOREIGN PATENT DOCUMENTS

CN 101873810 A 10/2010
CN 205233454 U 5/2016
(Continued)

OTHER PUBLICATIONS

Office Action dated Apr. 18, 2023, in Chinese Application No. 201980062903.3.
(Continued)

*Primary Examiner* — Khiem M Nguyen
(74) *Attorney, Agent, or Firm* — Sughrue Mion, PLLC

(57) ABSTRACT

Provided is an aerosol-generating article including a wrapper which is discolored as the aerosol-generating material is heated, the aerosol-generating article including: a tobacco rod; a front-end plug arranged on a side of the tobacco rod; a filter rod arranged on the other side of the tobacco rod; and the wrapper surrounding the tobacco rod, the front-end plug, and the filter rod, wherein the wrapper includes a thermochromic material which is heated and discolored by an aerosol-generating device when the aerosol-generating article is inserted into the aerosol-generating device.

11 Claims, 3 Drawing Sheets

(58) Field of Classification Search
USPC ..... 131/329
See application file for complete search history.

(56) References Cited

U.S. PATENT DOCUMENTS

| | | | | |
|---|---|---|---|---|
| 2017/0055576 | A1 | 3/2017 | Beeson et al. | |
| 2017/0340008 | A1 | 11/2017 | Sebastian et al. | |
| 2017/0347704 | A1 | 12/2017 | Oishi | |
| 2020/0268039 | A1 | 8/2020 | Lavanchy | |
| 2020/0359681 | A1 | 11/2020 | Han et al. | |
| 2021/0307380 | A1* | 10/2021 | Cheong | A24D 1/025 |
| 2023/0014502 | A1* | 1/2023 | Thorens | A24D 1/20 |

FOREIGN PATENT DOCUMENTS

| | | | |
|---|---|---|---|
| KR | 10-2008-0014297 | A | 2/2008 |
| KR | 10-2010-0094476 | A | 8/2010 |
| KR | 10-2015-0144089 | A | 12/2015 |
| KR | 10-2016-0084341 | A | 7/2016 |
| KR | 10-2017-0066335 | A | 6/2017 |
| KR | 10-2018-0099674 | A | 9/2018 |
| KR | 10-2018-0111460 | A | 10/2018 |
| WO | 99/44447 | A1 | 9/1999 |
| WO | 2015/177907 | A1 | 11/2015 |
| WO | 2016/135959 | A1 | 9/2016 |
| WO | 2017/114895 | A1 | 7/2017 |

OTHER PUBLICATIONS

International Search Report for PCT/KR2019/015427 dated Feb. 20, 2020 (PCT/ISA/210).
Extended European Search Report dated Dec. 15, 2021 in European Application No. 19886389.6.
Office Action dated Dec. 7, 2021 in Japanese Application No. 2020-559454.

* cited by examiner

AEROSOL-GENERATING ARTICLE AND AEROSOL-GENERATING SYSTEMS

CROSS REFERENCE TO RELATED APPLICATIONS

This application is a National Stage of International Application No. PCT/KR2019/015427 filed Nov. 13, 2019, claiming priority based on Korean Patent Application No. 10-2018-0146531 filed Nov. 23, 2018.

TECHNICAL FIELD

The present disclosure relates to an aerosol-generating article and an aerosol-generating system, and more particularly, to an aerosol-generating article in which a color of a wrapper is changed as the aerosol-generating article is heated and an aerosol-generating system including the same.

BACKGROUND ART

Recently, the demand for alternative methods to overcome the shortcomings of general aerosol-generating articles (cigarettes) has increased. For example, there is an increasing demand for a method of generating aerosol by heating an aerosol generating material in aerosol-generating articles, rather than by burning aerosol-generating articles.

When an aerosol is generated by burning an aerosol-generating article, a user may visually identify that the aerosol-generating article is being burnt and thus may identify the degree of smoking progress or a time when smoking is completed. However, when an aerosol-generating material exists inside the aerosol-generating article and is heated rather than burnt to generate an aerosol, the user has difficulty in identifying the degree of smoking progress or the time when smoking is completed.

DESCRIPTION OF EMBODIMENTS

Technical Problem

Provided are an aerosol-generating article and an aerosol-generating system which enable a user to visually identify the degree of smoking progress or a time when smoking is completed.

Technical Solution to Problem

According to an aspect of the present disclosure, an aerosol-generating article may include: a tobacco rod; a front-end plug arranged on a side of the tobacco rod; a filter rod arranged on the other side of the tobacco rod; and the wrapper surrounding the tobacco rod, the front-end plug, and the filter rod, wherein the wrapper includes a thermochromic material which is heated and discolored by an aerosol-generating device when the aerosol-generating article is inserted into the aerosol-generating device.

Advantageous Effects of Disclosure

As a wrapper of an aerosol-generating article includes a thermochromic material, the wrapper may discolor when the aerosol-generating article is heated. Therefore, a user may visually identify the degree of smoking progress or a time when smoking is completed.

The effects of the present disclosure are not limited to the examples described above, and further various effects are included in the present disclosure.

BEST MODE

Figure 1:
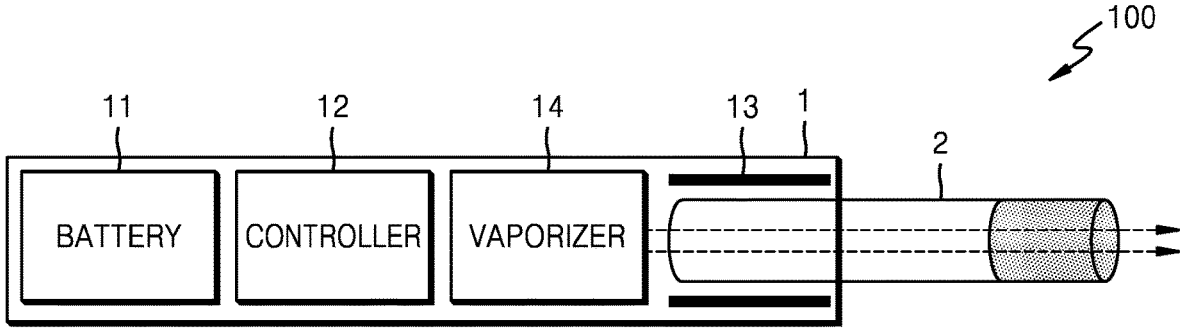
FIGS. 1 and 2 are diagrams illustrating examples in which an aerosol-generating article is inserted into an aerosol-generating device.

According to an aspect of the present disclosure, an aerosol-generating article may include: a tobacco rod; a front-end plug arranged on a side of the tobacco rod; a filter rod arranged on the other side of the tobacco rod; and the wrapper surrounding the tobacco rod, the front-end plug, and the filter rod, wherein the wrapper includes a thermochromic material which is heated and discolored by an aerosol-generating device when the aerosol-generating article is inserted into the aerosol-generating device.

The wrapper may include a first area located on a circumference of the front-end plug, a second area located on a circumference of the tobacco rod, and a third area located on a circumference of the filter rod, and the thermochromic material may be included in at least one of the first area, the second area, and the third area.

The thermochromic material may be discolored within a temperature range of about 50° C. to about 300° C. when heated by the aerosol-generating device.

The thermochromic material may be discolored after about 1 minute to about 10 minutes have elapsed from when the thermochromic material starts to be heated by the aerosol-generating device.

The thermochromic material may include a plurality of thermochromic elements, and one of the plurality of thermochromic elements may be discolored when the one thermochromic element reaches a different temperature than one other thermochromic element or when different times have elapsed for the one thermochromic element and the other thermochromic element.

The thermochromic material may include at least one of a cellulose-based material, a starch-based material, a polyamide-based material, an organic acid, and a pigment.

The thermochromic material may be coated or printed on the wrapper.

The thermochromic material may be included in an amount less than or equal to 10 wt % in the wrapper.

The wrapper may include: an inner wrapper surrounding at least one of the tobacco rod, the front-end plug, and the filter rod; and an outer wrapper surrounding the inner wrapper, wherein the thermochromic material is included in at least one of the inner wrapper and the outer wrapper.

The thermochromic material may be included in the inner wrapper, and at least a portion of the outer wrapper may be made of a semitransparent or transparent material.

According to another aspect of the present disclosure, an aerosol-generating system may include: an aerosol-generating article; and an aerosol-generating device into which the aerosol-generating article is inserted, wherein: the aerosol-generating device includes a battery and a heater which is heated by power supplied from the battery; and the aerosol-generating article includes a tobacco rod, a front-end plug arranged on a side of the tobacco rod, a filter rod arranged on the other side of the tobacco rod, and a wrapper surrounding the tobacco rod, the front-end plug, and the filter rod, wherein the wrapper includes a thermochromic material which is heated and discolored by the aerosol-generating device when the aerosol-generating article is inserted into the aerosol-generating device.

The heater may change a temperature for heating the aerosol-generating article from a first temperature to a second temperature, according to the number of puffs by a user, and, as the temperature is changed from the first temperature to the second temperature, the wrapper may be changed to different colors.

The first temperature may be a temperature higher than the second temperature.

MODE OF DISCLOSURE

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

Figure 2:
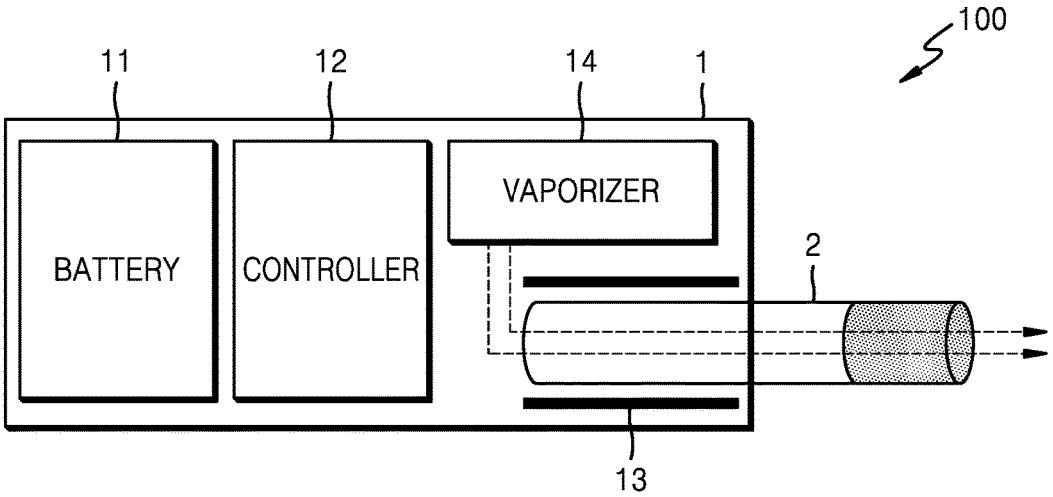

FIGS. 1 and 2 are diagrams showing examples in which an aerosol-generating article is inserted into an aerosol generating device.

Referring to FIGS. 1 and 2, an aerosol-generating system 100 includes an aerosol-generating device 1 and an aerosol-generating article 2 inserted into the aerosol-generating device 1.

The aerosol-generating device 1 includes a battery 11, a controller 12, a heater 13, and a vaporizer 14. Also, an aerosol-generating article 2 may be inserted into an inner space of the aerosol-generating device 1.

FIGS. 1 and 2 illustrate only components of the aerosol-generating device 1, which are related to the present embodiment. Therefore, it will be understood by one of ordinary skill in the art related to the present embodiment that other general-purpose components may be further included in the aerosol-generating device 1, in addition to the components illustrated in FIGS. 1 and 2.

Also, FIGS. 1 and 2 illustrate that the aerosol-generating device 1 includes the heater 13. However, according to necessity, the heater 13 may be omitted.

FIG. 1 illustrates that the battery 11, the controller 12, the vaporizer 14, and the heater 13 are arranged in series. Also, FIG. 2 illustrates that the vaporizer 14 and the heater 13 are arranged in parallel. However, the internal structure of the aerosol-generating device 1 is not limited to the structures illustrated in FIG. 1 or FIG. 2. In other words, according to the design of the aerosol-generating device 1, the battery 11, the controller 12, the vaporizer 14, and the heater 13 may be differently arranged.

When the aerosol-generating article 2 is inserted into the aerosol-generating device 1, the aerosol-generating device 1 may operate the vaporizer 14 to generate aerosol from the vaporizer 14. The aerosol generated by the vaporizer 14 is delivered to the user by passing through the aerosol-generating article 2. The vaporizer 14 will be described in more detail later.

The battery 11 may supply power to be used for the aerosol-generating device 1 to operate. For example, the battery 11 may supply power to heat the heater 13 or the vaporizer 14 and may supply power for operating the controller 12. Also, the battery 11 may supply power for operations of a display, a sensor, a motor, etc. mounted in the aerosol-generating device 1.

The controller 12 may generally control operations of the aerosol-generating device 1. In detail, the controller 12 may control not only operations of the battery 11, the heater 13, and the vaporizer 14, but also operations of other components included in the aerosol-generating device 1. Also, the controller 12 may check a state of each of the components of the aerosol-generating device 1 to determine whether or not the aerosol-generating device 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the aerosol-generating article 2 is inserted into the aerosol-generating device 1, the heater 13 may be located outside the aerosol-generating article 2. Thus, when the aerosol-generating article 2 is inserted into the aerosol-generating device 1, the heated heater 13 may increase a temperature of an aerosol generating material in the aerosol-generating article 2.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol-generating device 1 or may be set as a temperature desired by a user.

As another example, the heater 13 may include an induction heater. In detail, the heater 13 may include an electrically conductive coil for heating an aerosol-generating article in an induction heating method, and the aerosol-generating article may include a susceptor which may be heated by the induction heater.

FIGS. 1 and 2 illustrate that the heater 13 is positioned outside the aerosol-generating article 2, but the position of the aerosol-generating article 2 is not limited thereto. For example, the heater 13 may include a tube-type heating element, a plate-type heating element, a needle-type heating element, or a rod-type heating element, and may heat the inside or the outside of the aerosol-generating article 2, according to the shape of the heating element.

Also, the aerosol-generating device 1 may include a plurality of heaters 13. Here, the plurality of heaters 13 may be inserted into the aerosol-generating article 2 or may be arranged outside the aerosol-generating article 2. Also, some of the plurality of heaters 13 may be inserted into the aerosol-generating article 20, and the others may be arranged outside the aerosol-generating article 2. In addition, the shape of the heater 13 is not limited to the shapes illustrated in FIGS. 1 and 2 and may include various shapes.

The vaporizer 14 may generate an aerosol by heating a liquid composition and the generated aerosol may pass through the aerosol-generating article 2 to be delivered to a user. In other words, the aerosol generated via the vaporizer 14 may move along an air flow passage of the aerosol-generating device 1 and the air flow passage may be configured such that the aerosol generated via the vaporizer 14 passes through the aerosol-generating article 2 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol-generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be attached/detached to/from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol-generating device 1 may further include general-purpose components in addition to the battery 11, the controller 12, and the heater 13. For example, the aerosol-generating device 1 may include a display capable of outputting visual information and/or a motor for outputting haptic information. Also, the aerosol-generating device 1 may include at least one sensor. Also, the aerosol-generating device 1 may be formed as a structure where, even when the aerosol-generating article 2 is inserted into the aerosol-generating device 1, external air may be introduced or internal air may be discharged.

Although not illustrated in FIGS. 1 and 2, the aerosol-generating device 1 and an additional cradle may form together a system. For example, the cradle may be used to charge the battery 11 of the aerosol-generating device 1. Alternatively, the heater 13 may be heated when the cradle and the aerosol-generating device 1 are coupled to each other.

The aerosol-generating article 2 may be similar as a general combustive aerosol-generating article. For example, the aerosol-generating article 2 may be divided into a first portion including an aerosol generating material and a second portion including a filter, etc. Alternatively, the second portion of the aerosol-generating article 2 may also include an aerosol generating material. For example, an aerosol generating material made in the form of granules or capsules may be inserted into the second portion.

The entire first portion may be inserted into the aerosol-generating device 1, and the second portion may be exposed to the outside. Alternatively, only a portion of the first portion may be inserted into the aerosol-generating device 1, or a portion of the first portion and a portion of the second portion may be inserted thereinto. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol-generating device 1. For example, the opening and closing and/or a size of the air passage formed in the aerosol-generating device 1 may be adjusted by the user. Accordingly, the amount of smoke and a smoking impression may be adjusted by the user. As another example, the external air may flow into the aerosol-generating article 2 through at least one hole formed in a surface of the aerosol-generating article 2.

Hereinafter, an example of the aerosol-generating article 3 will be described with reference to FIG. 3.

Figure 3:
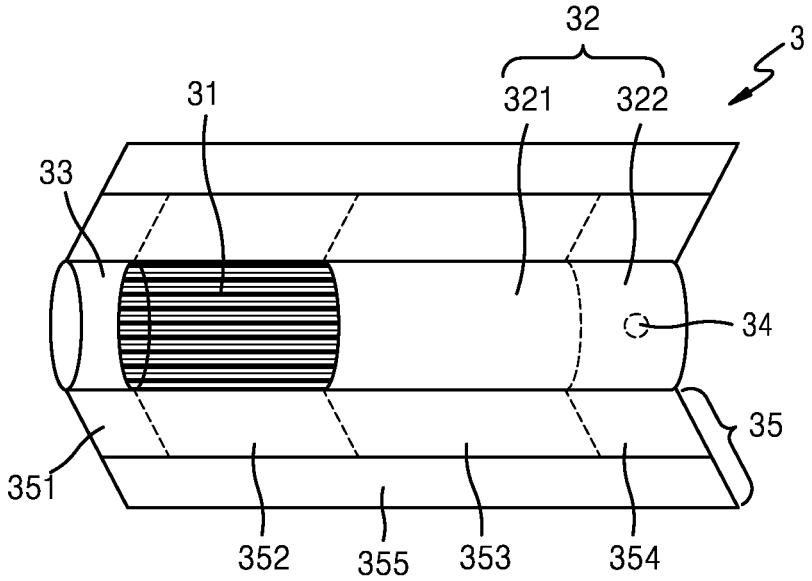
FIGS. 3 and 4 are views illustrating examples of an aerosol-generating article.

FIG. 3 is a drawing illustrating an example of an aerosol-generating article.

Referring to FIG. 3, the aerosol-generating article 3 includes a tobacco rod 31, a filter rod 32, and a front-end plug 33. The first portion described above with reference to FIGS. 1 and 2 includes the tobacco rod 31 and the front-end plug 33, and the second portion includes the filter rod 32.

The filter rod 32 may include a plurality of segments. For example, the filter rod 32 may include a first segment for cooling an aerosol and a second segment for filtering a preset component included in the aerosol. Also, as needed, the filter rod 31 may further include at least one segment for performing other functions.

The front-end plug 33 may be made of a cellulose acetate.

The front-end plug 33 is located on a side of the tobacco rod 31 which is opposite to the filter rod 32. The front-end plug 33 may prevent the tobacco rod 31 from being detached to the outside and prevent a liquefied aerosol from flowing into the aerosol-generating device 1 of FIGS. 1 through 3 from the tobacco rod 31 during smoking.

Also, as needed, the front-end plug 33 may include at least one channel, and a cross-sectional shape of the channel may include various shapes.

The tobacco rod 31 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 31 may include other additives, such as flavors, a wetting agent, and/or organic acid. Also, the tobacco rod 31 may include a flavored liquid, such as menthol or a moisturizer, which is injected to the tobacco rod 31.

The tobacco rod 31 may be manufactured in various forms. For example, the tobacco rod 31 may be formed as a sheet or a strand. Also, the tobacco rod 31 may be formed as a pipe tobacco, which is formed of tiny bits cut from a tobacco sheet. Also, the tobacco rod 31 may be surrounded by a heat conductive material. For example, the heat-conducting material may be, but is not limited to, a metal foil such as aluminum foil. For example, the heat conductive material surrounding the tobacco rod 31 may uniformly distribute heat transmitted to the tobacco rod 31, and thus, the heat conductivity applied to the tobacco rod may be increased and taste of the tobacco may be improved. Also, the heat conductive material surrounding the tobacco rod 31 may function as a susceptor heated by the induction heater. Here, although not illustrated in the drawings, the tobacco rod 31 may further include an additional susceptor, in addition to the heat conductive material surrounding the tobacco rod 31.

A first segment 321 of the filter rod 32 may be made of cellulose acetate. For example, the first segment 321 may be a tube-type structure having a hollow inside.

A second segment 322 of the filter rod 32 may be made of cellulose acetate.

Also, the second segment 322 may include at least one capsule 34. Here, the capsule 34 may generate a flavor or an aerosol. For example, the capsule 34 may have a configuration in which a liquid containing a flavoring material is wrapped with a film. For example, the capsule 34 may have a spherical or cylindrical shape, but is not limited thereto.

The aerosol-generating article 3 may be packaged via at least one wrapper 35. The wrapper 35 may have at least one hole through which external air may be introduced or internal air may be discharged. For example, the front-end plug 33 may be packaged via a first wrapper 351, the tobacco rod 31 may be packaged via a second wrapper 352, the first segment 321 may be packaged via a third wrapper 353, and the second segment 322 may be packaged via a fourth wrapper 354. Also, the entire aerosol-generating article 3 may be repackaged via a fifth wrapper 355.

In the aerosol-generating article 3, the tobacco rod 31 is located in the middle and heated, thereby generating an aerosol. In other words, because the aerosol-generating article 3 is not burnt, the degree of smoking progress may not be identified through a change in a length of the aerosol-generating article 3.

Hereinafter, on the basis of the structure illustrated in FIGS. 1 through 3, referring to FIGS. 4 and 5, an aerosol-generating article configured to enable a user to visually identify the degree of smoking progress and a smoking completion time will be described.

The wrapper 35 includes a thermochromic material that is heated and discolored by the heater 13 when the aerosol-generating article 3 is inserted into the aerosol-generating device 1.

The thermochromic material included in the wrapper 35 may be discolored within a range of about 50° C. to about 300° C. Alternatively, the thermochromic material may be discolored within a range of about 100° C. to about 250° C. but is not limited to the described temperature range.

Also, the thermochromic material may be discolored after about 1 minute to about 10 minutes have elapsed from when the aerosol-generating article 3 starts to be heated by the heater 13. Alternatively, when about 3 minutes to about 6 minutes have elapsed, the thermochromic material may be discolored but is not limited to the described time range.

For example, when the aerosol-generating article 3 is set to be heated at a temperature of 100° C. after about 6 minutes have elapsed from when the heater 13 starts heating, and the wrapper 35 includes a thermochromic material discolored at the temperature of 100° C., the thermochromic material may be discolored after 6 minutes have elapsed from when the aerosol-generating article 3 starts to be heated.

Also, the thermochromic material may be discolored to black, blue, sky blue, magenta, cyan, red, orange, yellow, purple, green, or the like but is not limited to the listed colors.

In addition, the thermochromic material may be included in an amount less than or equal to 10 wt % in the wrapper 35. Alternatively, the thermochromic material may be included in an amount of about 0.1 wt % to about 5 wt % in the wrapper 35 but is not limited to the described range of wt %.

Also, the thermochromic material may be coated or printed on the wrapper 35. Alternatively, the thermochromic material may be dyed on the wrapper 35.

Also, the thermochromic material may include at least one of a cellulose-based material, a starch-based material, a polyamide-based material, an organic acid, and a pigment.

The organic acid included in the thermochromic material may include at least one or a combination of boric acid, oxalic acid, maleic acid, tartaric acid, citric acid, gallic acid, succinic acid, benzoic acid, stearic acid, salicylic acid, tannic acid, uric acid, trimellitic acid, pyromellitic acid, phthalic acid, terephthalic acid, anthranilic acid, 1-hydroxy-2-naphthoic acid, m-hydroxybenzoic acid, 2-hydroxy-p-toluic acid, methylenebis(salicyclic) acid, p-oxybenzoic acid, and β-naphthoic acid.

Also, the pigment included in the thermochromic material may include at least one or a combination of bis(dimethylammonium) tetrachloronickelate, bis(diethylammonium) tetrachlorocuprate, vanadium dioxide, and nickel sulfate.

Figure 4:
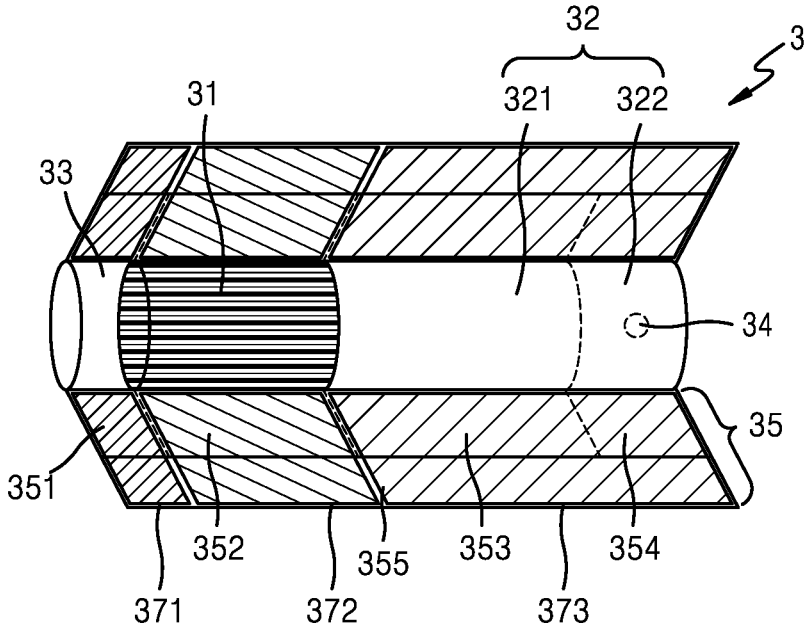

As illustrated in FIG. 4, the wrapper 35 may include a first area 371 located on a circumference of the front-end plug 33, a second area 372 located on a circumference of the tobacco rod 31, and a third area 373 located on a circumference of the filter rod 32. The thermochromic material may be included in at least one of the first area 371, the second area 372, and the third area 373.

For example, the thermochromic material may be included in the first wrapper 351 and the fifth wrapper 355 included in the first area 371. As another example, the thermochromic material may be included in the second wrapper 352 and the fifth wrapper 355 included in the second area 372. As another example, the thermochromic material may be included in the third wrapper 353 and the fifth wrapper 355 included in the third area 373.

The third area 373 may be divided into an area included in the first segment 321 and an area included in the second segment 322, and the thermochromic material may be included in at least one of the areas divided as described above.

Also, the wrapper 35 may be included in at least one of an inner wrapper corresponding to the first wrapper 351, the second wrapper 352, the third wrapper 353, and the fourth wrapper 354 and an outer wrapper corresponding to the fifth wrapper 355. In other words, the thermochromic material may be included merely in the inner wrapper, may be included merely in the outer wrapper, or may be included in both the inner wrapper and the outer wrapper. When the thermochromic material is included merely in the inner wrapper, the outer wrapper corresponding to an area in which the thermochromic material is included may be made of a semitransparent or transparent material, so that a user may visually identify that the thermochromic material is being discolored.

For example, when the thermochromic material is included merely in the first wrapper 351, a portion corresponding to the first area 371 in the fifth wrapper 355 may be made of a semitransparent or transparent material.

The thermochromic material included in the wrapper 35 may include a plurality of thermochromic elements. The plurality of thermochromic elements may be discolored at different temperatures or may be discolored to different colors.

For example, thermochromic material may include a plurality of thermochromic elements which are discolored to different colors at different temperatures, so that the wrapper 35 may be discolored to various colors as a heating temperature of the heater 13 changes.

As another example, the thermochromic material may include a plurality of thermochromic elements which are discolored to the same color at different temperatures or to a color only with different chromas, so that chroma of the wrapper 35 may be gradually increased or gradually lowered as the heating temperature of the heater 13 changes.

Also, a thermochromic material considering the temperature of the heater 13 may be used. For example, the heating temperature of the heater 13 may be changed from a first temperature to a second temperature according to the number of puffs, the wrapper 35 may use a thermochromic material that is discolored to different colors at the first temperature and the second temperature. Therefore, as the temperature of the heater 13 is changed from the first temperature to the second temperature according to the number of puffs, the color of the wrapper 35 may be changed in stages.

Figure 5:
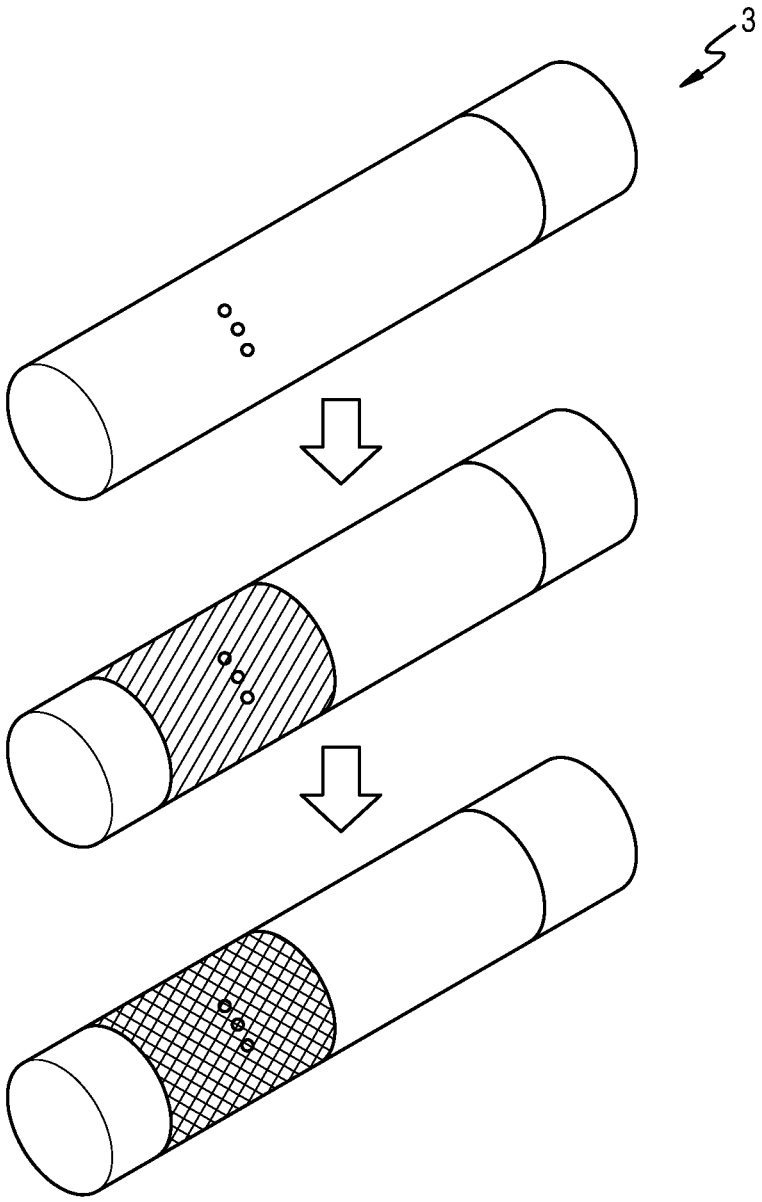
FIG. 5 is a view illustrating an example of an aerosol-generating article which discolors as smoking progresses.

As the heater 13 heats the aerosol-generating article 3, as illustrated in FIG. 5, the color of the wrapper 35 of the aerosol-generating article 3 may be changed in time series. The picture illustrated on the top of FIG. 5 indicates that the aerosol-generating article 3 is not discolored, the picture illustrated in the middle of FIG. 5 indicates that the aerosol-generating article 3 is discolored to a first color, and the picture illustrated at the bottom of FIG. 5 indicates that the aerosol-generating article 3 is additionally discolored to a second color.

Through the wrapper 35 of the aerosol-generating article 3 that is not discolored, the user may identify that the aerosol-generating article 3 is not used for smoking. Also, through the wrapper 35 that is discolored to the first color, the user may identify that the aerosol-generating article 3 is used for smoking and may be used for additional smoking. In addition, through wrapper 35 that is additionally discolored to the second color, the user may identify that the aerosol-generating article 3 may be no longer used for smoking.

Here, the first color and the second color may be used as different colors to visually clearly distinguish and transmit a smoking stage to the user. For example, the first color may be green, and the second color may be red.

Alternatively, the same color as the first color or a color having merely a different chroma may be used to visually transmit the degree of smoking progress to the user through the degree of chroma change. For example, light yellow may be used for the first color and dark yellow may be used for the second color to notify the user of the degree of smoking progress through the color of the aerosol-generating article 3 that is gradually changed to dark yellow.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. An aerosol-generating article comprising:
a tobacco rod;
a front-end plug arranged on a side of the tobacco rod;
a filter rod arranged on the other side of the tobacco rod; and
a wrapper surrounding the tobacco rod, the front-end plug, and the filter rod, wherein
the wrapper comprises at least one thermochromic material that is configured to be heated and discolored by an aerosol-generating device when the aerosol-generating article is inserted into the aerosol-generating device,
wherein the wrapper further comprises:
an inner wrapper surrounding at least one from among the tobacco rod, the front-end plug, and the filter rod; and
an outer wrapper surrounding the inner wrapper,
wherein the at least one thermochromic material is included in the inner wrapper, and
wherein at least a portion of the outer wrapper, that overlaps the at least one thermochromic material, is made of a semitransparent or transparent material.

2. The aerosol-generating article of claim 1, wherein
the wrapper comprises a first area located on a circumference of the front-end plug, a second area located on a circumference of the tobacco rod, and a third area located on a circumference of the filter rod, and
the at least one thermochromic material is included in at least one from among the first area, the second area, and the third area.

3. The aerosol-generating article of claim 1, wherein the at least one thermochromic material is configured to be discolored within a temperature range of 50° C. to 300° C. when heated by the aerosol-generating device.

4. The aerosol-generating article of claim 1, wherein the at least one thermochromic material is configured to be discolored after 1 minute to 10 minutes have elapsed from when the at least one thermochromic material starts to be heated by the aerosol-generating device.

5. The aerosol-generating article of claim 1, wherein
the at least one thermochromic material comprises a plurality of thermochromic elements, and the plurality of thermochromic material comprises a first thermochromic element and a second thermochromic element that are configured to be discolored at different temperatures or different elapsed heating times with respect to each other.

6. The aerosol-generating article of claim 1, wherein the at least one thermochromic material comprises at least one of from among a cellulose-based material, a starch-based material, a polyamide-based material, an organic acid, and a pigment.

7. The aerosol-generating article of claim 1, wherein the at least one thermochromic material is coated or printed on the wrapper.

8. The aerosol-generating article of claim 1, wherein the at least one thermochromic material is included in an amount less than or equal to 10 wt % in the wrapper.

9. An aerosol-generating system comprising:

an aerosol-generating article; and an aerosol-generating device into which the aerosol-generating article is configured to be inserted, wherein the aerosol-generating device comprises a battery and a heater which is configured to be heated by power supplied from the battery; and wherein the aerosol-generating article comprises:

a tobacco rod, a front-end plug arranged on one side of the tobacco rod, a filter rod arranged on another side of the tobacco rod, opposite to the one side, and a wrapper surrounding the tobacco rod, the front-end plug, and the filter rod, wherein the wrapper comprises at least one thermochromic material that is configured to be heated and discolored by the aerosol-generating device when the aerosol-generating article is inserted into the aerosol-generating device, wherein the wrapper further comprises:

an inner wrapper surrounding at least one from among the tobacco rod, the front-end plug, and the filter rod; and an outer wrapper surrounding the inner wrapper, wherein the at least one thermochromic material is included in the inner wrapper, and wherein at least a portion of the outer wrapper, that overlaps the at least one thermochromic material, is made of a semitransparent or transparent material.

10. The aerosol-generating system of claim 9, wherein the heater is configured to change a temperature for heating the aerosol-generating article from a first temperature to a second temperature, according to a number of puffs by a user, and, as the temperature is changed from the first temperature to the second temperature, the wrapper is configured to be changed to different colors.

11. The aerosol-generating system of claim 10, wherein the first temperature is a temperature higher than the second temperature.

* * * * *